US010065244B2

(12) United States Patent
Hwang et al.

(10) Patent No.: US 10,065,244 B2
(45) Date of Patent: Sep. 4, 2018

(54) METHOD FOR FABRICATING POROUS SPHERICAL IRON-BASED ALLOY POWDER

(71) Applicant: TAIWAN POWDER TECHNOLOGIES CO., LTD., Taoyuan (TW)

(72) Inventors: Kuen-Shyang Hwang, Taipei (TW); Ming-Wei Wu, Taipei (TW); Yang-Liang Fan, Taoyuan (TW)

(73) Assignee: Taiwan Powder Technologies Co., Ltd., Taoyuan (TW)

( * ) Notice: Subject to any disclaimer, the term of this patent is extended or adjusted under 35 U.S.C. 154(b) by 79 days.

(21) Appl. No.: 15/131,367

(22) Filed: Apr. 18, 2016

(65) Prior Publication Data

US 2017/0297114 A1 Oct. 19, 2017

(51) Int. Cl.

| | |
|---|---|
| ***B22F 9/22*** | (2006.01) |
| ***B22F 9/04*** | (2006.01) |
| ***B22F 1/00*** | (2006.01) |
| ***B22F 3/10*** | (2006.01) |
| ***C22C 38/12*** | (2006.01) |
| ***C22C 38/08*** | (2006.01) |

(52) U.S. Cl.

CPC ..... *B22F 9/22* (2013.01); *B22F 1/0048* (2013.01); *B22F 3/10* (2013.01); *B22F 9/04* (2013.01); *C22C 38/08* (2013.01); *C22C 38/12* (2013.01); *B22F 2201/01* (2013.01); *B22F 2301/35* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 7,740,796 | B2 * | 6/2010 | Oda | C23C 14/3414 148/306 |
| 8,940,075 | B2 * | 1/2015 | Hwang | B22F 9/22 419/26 |
| 2009/0087372 | A1 * | 4/2009 | Buchholz | C01B 32/162 423/447.2 |

FOREIGN PATENT DOCUMENTS

| | | | |
|---|---|---|---|
| DE | 102006027851 | B3 | 12/2007 |
| TW | I294318 | B | 3/2008 |
| TW | 201718901 | A * | 6/2017 |

OTHER PUBLICATIONS

Walther, G. et al., "New Processing Route for Production of Fine Spherical Iron Powder", Euro PM2015—Powder Manufacturing, European Powder Metallurgy Association, 2015 (6 pp.).*

* cited by examiner

*Primary Examiner* — George P Wyszomierski

(74) *Attorney, Agent, or Firm* — Muncy, Geissler, Olds & Lowe, P.C.

(57) ABSTRACT

The present invention discloses a method for fabricating a porous spherical iron-based alloy powder, a powder thereof and a sintered body thereof. The method comprises steps: mixing an iron oxide powder and an alloying powder to form a mixed powder; spray-granulating the mixed powder to form a spherical spray-granulated powder; and placing the spherical spray-granulated powder in a reducing environment and heating it to a temperature of lower than 700° C. to obtain a porous spherical iron-based alloy powder having high flowability, high compressibility, superior sinterability and low cost.

6 Claims, 2 Drawing Sheets

METHOD FOR FABRICATING POROUS SPHERICAL IRON-BASED ALLOY POWDER

FIELD OF THE INVENTION

The present invention relates to a method for fabricating an iron-based alloy powder, a powder thereof and a sintered body thereof, particularly to a granulation-reduction method for fabricating a porous spherical iron-based alloy powder, a powder thereof and a sintered body thereof.

BACKGROUND OF THE INVENTION

Powder metallurgy is a commonly-seen fabrication technology of metallic products. The powder thereof has an average particle diameter of about 70 μm, which is a coarse powder having large space among particles. The large space among particles results in the large porosity and poor mechanical properties of the sintered products. Compared with finer powder, coarse powder has longer diffusion length, which causes poor homogeneity of the alloying elements thereof. Further, coarse powder has smaller surface area, which leads to weaker sintering driving force, lower sintered density and poorer product quality.

A fine iron powder, such as a carbonyl iron powder, has high specific surface area and superior sinterability and thus can be sintered to a high density. However, fine powder is poor in flowability and hard to flow into the mold cavity. Thus, the powder metallurgy thereof is hard to automate. Carbonyl iron powder is fabricated in a high-temperature and high-pressure chemical reaction. Therefore, carbonyl iron powder has the disadvantage of high cost. Fine iron powder can also be fabricated with a water atomization method. However, the iron powder fabricated thereby still has the problem of poor flowability, low yield and high cost. The fine iron powders fabricated with other conventional methods have same drawbacks.

To solve the above-mentioned problems encountered as one desires to produce a powder with high compressibility, good sinterability and homogeneity, the Inventors of the present invention had proposed a solution involving "Sinter-Hardened Powder and Sintered Body Thereof" disclosed in a Taiwan patent No. I294318 and a German patent No. DE102006027851, wherein the sinter-hardened powder comprises iron, carbon, nickel, chromium and molybdenum with iron being the primary constituent. The sinter-hardened powder adopts a fine powder having a particle size of 0.1-3 μm, such as a carbonyl iron powder. After spray granulation, the powder has flowability and can be shaped with a dry-compression process. After sintering, the product has high density, and the alloying elements thereof are homogenously distributed. Because of adopting carbonyl iron powder, the sinter-hardened powder still has the problem of high cost. While containing carbon, the carbonyl iron powder has high hardness and poor compressibility, resulting in low green compact density, likely to abrade the molds, and thus unfavorable to industrial application.

SUMMARY OF THE INVENTION

The primary objective of the present invention is to solve the conventional problem in the powder metallurgy industry: the high cost of the fine iron powder, which is used to fabricate powder-metallurgy products having high density, superior mechanical properties and homogeneous microstructure.

In order to achieve the abovementioned objective, the present invention proposes a reduction method for fabricating a porous spherical iron-based alloy powder, which comprises Step 1: mixing an iron oxide powder and alloying powders to form a mixed powder; Step 2: spray-granulating the mixed powder to form a spherical spray-granulated powder; and Step 3: placing the spherical spray-granulated powder in a reducing environment and heating it to a temperature of lower than 700° C. to obtain a porous spherical iron-based alloy powder having a specific surface area of greater than 0.9 $m^2/g$.

The present invention also proposes a porous spherical iron-based alloy powder fabricated in the abovementioned method.

The present invention further proposes an iron-based alloy sintered body, which is fabricated with the abovementioned porous spherical iron-based alloy powder in a sintering process.

The Inventors found that a porous spherical iron-based alloy powder having spherical particles and a great quantity of pores can be obtained via reducing the spherical spray-granulated powder at a temperature of lower than 700° C. The sphericity of the particles can increase the flowability of the powder and make the powder easy to enter into the mold cavity in the dry-compression shaping process. The porous structure increases the specific surface area, which favors the sintering reaction and generates high sintered density. The porous spherical iron-based alloy powder of the present invention is much less expensive than the alloyed powder produced with carbonyl iron powder or other fine iron powders and is fabricated at a lower reduction temperature. Therefore, the present invention can reduce the cost of products.

While the alloying powder is an alloying-element-containing powder, the alloying elements are neither diffused into the iron powder nor homogenized at the low reduction temperature. Therefore, the iron powder after reduction still preserves the low hardness and high compressibility, easy to fabricate into high-density green compacts and favoring generation of high sintered density. Because of the lower reduction temperature of the present invention, some carbon-containing powder, such as graphite powder or carbon black powder, can be introduced into the mixed powder to assist in reducing the iron oxide powder and metal oxide powder, The added carbon neither diffuses deeply into the interior of the particles of the iron powder nor causes a huge drop in the compressibility. In the conventional process of making reduced iron powders or iron-based alloy powders, the iron oxide powder would be reduced at a high temperature and thus the reduction reaction can be accelerated. However, high temperature leads to high hardness, low compressibility, low specific surface area and poor sinterability of the iron powder and thus hinders the green compacts from being sintered to high density.

DETAILED DESCRIPTION OF THE PREFERRED EMBODIMENTS

Figure 1:
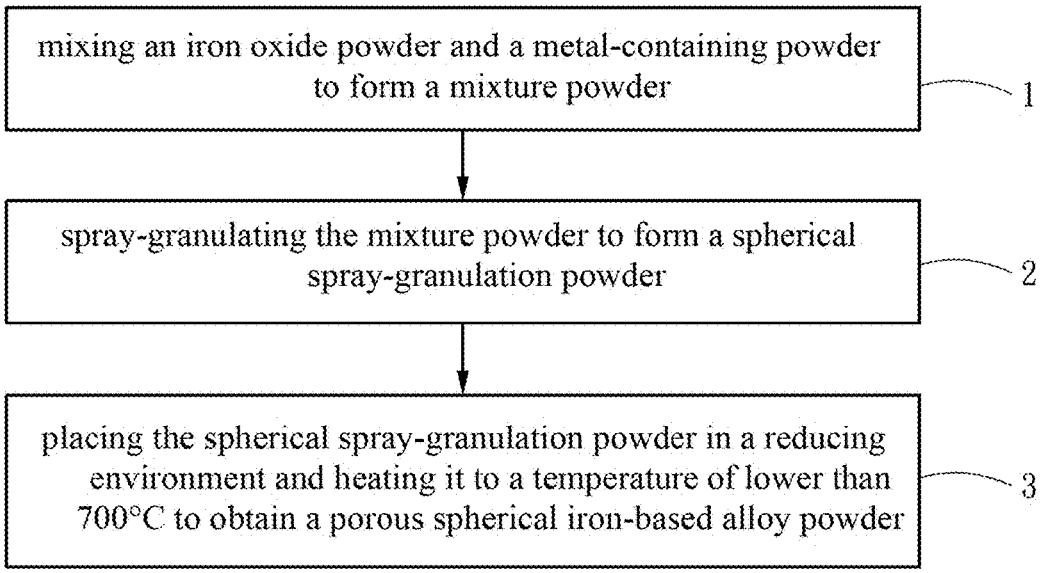
FIG. 1 is a flowchart of a method for fabricating a porous spherical iron-based alloy powder according to one embodiment of the present invention.

Refer to FIG . 1, a flowchart of the method according to one embodiment of the present invention. The reduction method for fabricating a porous spherical iron-based alloy powder of the present invention comprises Steps 1-3.

In Step 1, mix an iron oxide powder and an alloying powder to form a mixed powder. In one embodiment, the iron oxide powder is an iron(III) oxide ($Fe_2O_3$) powder or an iron (II,III) oxide ($Fe_3O_4$) powder, having an average particle diameter of 0.1-5 μm. The alloying powder is a metallic element powder, a metallic alloy powder, a metal oxide powder, or a combination thereof. The metallic element powder contains at least one element selected from a group including nickel (Ni), molybdenum (Mo), tungsten (W), copper (Cu), and combinations thereof. The metallic alloy powder is an iron-based alloy powder containing at least one alloying element selected from a group including chromium (Cr), silicon (Si), vanadium (V), manganese (Mn), niobium (Nb), and combinations thereof, such as a Fe—Si powder, or a Fe—Cr—Mn powder. The metal oxide powder contains at least one metal oxide selected from a group including nickel oxide (NiO), molybdenum oxide ($MoO_3$), tungsten oxide ($WO_3$), cupric oxide (CuO), cuprous oxide ($Cu_2O$), and combinations thereof.

In Step 2, spray-granulate the mixed powder to form a spherical spray-granulated powder.

In Step 3, place the spherical spray-granulated powder in a reducing environment and heat it to a temperature of lower than 700° C. to obtain a porous spherical iron-based alloy powder having a specific surface area of greater than 0.9 $m^2/g$. In one embodiment, the specific surface area ranges from 0.9 to 20 $m^2/g$.

powder or the metal oxide powder. The lower reduction temperature used by the present invention neither diffuses carbon into the interior of the particles of the iron powder nor decreases much on the compressibility of the iron powder.

Below, the reduction method for fabricating a porous spherical iron-based alloy powder of the present invention will be described in further detail with experiments made according to embodiments of the present invention and comparisons made according to other methods. Table. 1 lists the chemical compositions of the experiments and comparisons. Table. 2 lists the fabrication conditions, particle sizes, specific surface areas, green compact densities (%), and sintered densities (%) of the porous spherical iron-based alloy powder of the experiments and comparisons. The experiments and comparisons described below are undertaken in a reducing environment of a hydrogen atmosphere.

TABLE 1 weight percent (wt. %) of the powders used in the experiments and comparisons

| Serial No. | $Fe_2O_3$ | $Fe_3O_4$ | NiO | Ni | 316L | Mo | C |
|---|---|---|---|---|---|---|---|
| Composition 1 | 91.1 | — | 4.9 | — | 3.5 | 0.5 | — |
| Composition 2 | 93 | — | 5.4 | — | — | 0.6 | 1 |
| Composition 3 | — | 97 | — | 2 | — | 0.5 | 0.5 |

TABLE 2 the fabrication conditions, particle sizes, specific surface areas, green compact densities (%), and sintered densities (%) of Experiments 1-4 and Comparisons 1-3

| Serial No. | Composition | Reduction temperature and reduction time | Particle size after reduction (μm) | BET specific surface area of reduced powder ($m^2/g$) | Green compact density (%) | Sintered density (%) |
|---|---|---|---|---|---|---|
| E1 | Composition 1 | 600° C., 3 hr | 48.7 μm | 4.55 | 73.4 | 98.9 |
| E2 | Composition 1 | 650° C., 3 hr | 63.1 μm | 3.20 | 74.4 | 97.9 |
| E3 | Composition 2 | 600° C., 3 hr | 71.8 μm | 2.56 | 73.9 | 94.6 |
| E4 | Composition 3 | 690° C., 3 hr | 67.3 μm | 1.26 | 77.0 | 95.6 |
| C1 | Composition 1 | 750° C., 3 hr | 75.1 μm | 0.20 | 79.2 | 91.5 |
| C2 | Composition 1 | 800° C., 3 hr | 77.3 μm | 0.08 | 79.4 | 89.7 |
| C3 | Composition 2 | 750° C., 3 hr | 41.3 μm | 0.86 | 73.1 | 92.6 |

The reducing environment is a pure hydrogen atmosphere, a cracked ammonia atmosphere, or other reducing atmospheres. The reduction temperature is preferably within 500-700° C. The particle size of the porous spherical iron-based alloy powder is preferably within 5-80 μm. The specific surface area of the porous spherical iron-based alloy powder is preferably greater than 0.9 $m^2/g$. In one embodiment, the porous spherical iron-based alloy powder contains the nickel element having a weight percentage less than 7% and at least one enhancing element each having a weight percentage less than 1% with the iron element being the balance. The enhancing element is an element selected from a group including molybdenum, chromium, vanadium, tungsten, carbon, copper, manganese, niobium, and silicon. In one embodiment, the material of the porous spherical iron-based alloy powder is one of commercial iron-based alloys and prepared according to the proportions of the iron oxide powder and the alloying powder.

Figure 2:
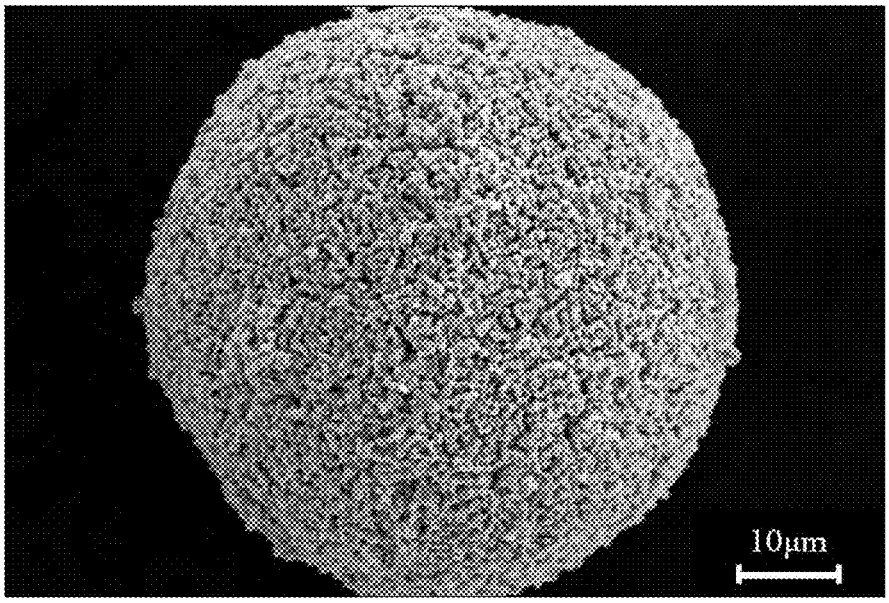
FIG. 2 is a scanning electron microscope photograph of a spherical porous iron-based alloy powder obtained in Experiment 1.

In one embodiment, the iron oxide powder and the alloying powder are mixed with a carbon-containing powder, such as graphite powder or carbon black powder, whereby to assist in reducing a portion of the iron oxide Experiments 1 and 2 (E1 and E2) adopt the mixed powder of Composition 1, wherein the iron oxide powder has an average particle size of 0.3 μm, and wherein the 316 stainless steel powder contains 17 wt. % chromium, 10.4 wt. % nickel, 2.2 wt. % molybdenum, 1.6 wt. % manganese and 0.6 wt. % silicon and has an average particle size of 8 μm, and wherein the molybdenum powder has an average particle size of 3 μm. After a bonding agent, a plasticity agent and water are added to the mixture, the mixed powder is spray-granulated to obtain a spherical spray-granulated powder. After examination of cross sections, no large hollow cavity is found in the particles. The spray-granulated powder is reduced respectively at a reduction temperature of 600° C. and 650° C. for 3 hours to obtain spherical porous iron-based alloy powders, which respectively have specific surface areas of 4.55 $m^2/g$ and 3.20 $m^2/g$, green compact densities of over 70% (superior compressibility) at a pressure of 600 MPa, and sintered densities of 98.9% and 97.9%. The sintered specimen has a composition of Fe-5.9Ni-0,8Cr-0.8Mo-0.1Mn. FIG. 2 is the scanning electron microscope photograph of the spherical porous iron-based alloy powder. The photograph shows that the particle of the spherical porous iron-based alloy powder has a well spherical shape, a great quantity of micro pores and a large surface area. The large surface area implies that the spherical porous iron-based alloy powder has a great sintering driving force. The cross-section examination shows that the particles have micro pores uniformly distributed inside and are free of large hollow cavities in the cores thereof. Therefore, the spherical porous iron-based alloy powder of the present invention has superior flowability and is suitable for the dry compression shaping process.

Experiment 3 (E3) adopts the mixed powder of Composition 2. The spray-granulated powder is reduced at a reduction temperature of 600° C. for 3 hours to obtain a spherical porous iron-based alloy powder, which has a specific surface area of 2.56 $m^2/g$, a green compact density of over 70% (superior compressibility), and a sintered density of 94.6%. Via a high-power scanning electron microscope, it is observed that the spherical porous iron-based alloy powder has a well spherical shape and a great quantity of pores.

Experiment 4 (E4) mixes $Fe_3O_4$ oxide powder, elemental pure Ni powder, and elemental pure Mo powders based on Composition 3. The spray-granulated powder is reduced at a reduction temperature of 690° C. for 3 hours to obtain a spherical porous iron-based alloy powder, which has a specific surface area of 1.26 $m^2/g$ and a sintered density of 95.6%, The spherical porous iron-based alloy powder has a well spherical shape and a great quantity of pores.

Comparisons 1 and 2 (C1 and C2) adopt the mixed powder of Composition 1. The spray-granulated powder is reduced respectively at a reduction temperature of 750° C. and 800° C. for 3 hours to obtain iron-based alloy powders, which respectively have specific surface areas of only 0.2 $m^2/g$ and 0.08 $m^2/g$ and green compact densities of 79.2% and 79.4% (higher than the experiments). Although the iron-based alloy powder has a slightly spherical shape, only a few pores formed in the powder. The lack of internal pores causes small specific surface area and low driving force for sintering, which results in low sintered densities of only 91.5% and 89.7.9%, respectively.

Comparison 3 (C3) adopts the mixed powder of Composition 2. The spray-granulated powder is reduced at a reduction temperature of 750° C. for 3 hours to obtain an iron-based alloy powder, which has a specific surface area of only 0.86 $m^2/g$, a green compact density of 73.1% and a sintered density of only 92.6%.

Comparison 4 (C4) adopts the pre-alloyed powder with a mean particle size of 14 μm and a composition of Fe-6.0Ni-0.8Cr-0.8Mo. C4 does not undergo a reduction process and its composition is similar to that of sintered E1 specimen. With the same spray drying, pressing, and sintering processes, the green density and sintered density are about 70% and 92%, respectively, of the theoretical density, which are lower than those obtained for E1. The reason is that pre-alloyed C4 powder is hard. In contrats, the alloying elements, such as Ni, Mo, and Cr are not truly alloyed in E1 due to the low reduction temperature. Thus, the compressibility of E1 is better than C4. Furthermore, the sintered density of C4 is lower than that of E1 because the C4 powder has a low surface area of 0.013 $m^2/g$ and thus a low driving force for sintering.

The Inventors found that reducing the spray-granulated powder at a reduction temperature of lower than 700° C. can obtain an iron-based alloy powder whose particles have a spherical shape and a great quantity of pores and are free of large hollow cavities in the cores thereof. The characteristics of the spherical shape and free of large hollow cavity enhance the flowability of the powder and help the powder enter into the mold cavity in the dry compression shaping process. The characteristic of high porosity provides large surface area and favors sintering and obtaining high sintered density. The lower reduction temperature used by the present invention exempts the carbon and alloying elements from reacting with iron. Thus, the powder has low hardness and high compressibility. The present invention adopts iron oxide powder, which is less expensive than carbonyl iron powder or other fine iron powders, and thus can reduce the overall cost of the fabrication process.

While the alloying powder adopts an alloying-element powder, such as a nickel powder, the lower reduction temperature of the present invention would not homogenize the alloying element. Thus, the low hardness and high compressibility of the reduced iron powder is retained. Therefore, high green compact density and high sintered density is still likely to achieve in such a case. In some embodiments, a carbon-containing powder, such as a graphite powder or a carbon black powder, is added to the iron oxide powder to assist in reducing a portion of the iron oxide powder and the metal oxide powder. Because of the lower reduction temperature of the present invention, the carbon atoms will not diffuse into the interior of the particles of the iron powder, neither generating high-hardness steel nor decreasing the compressibility. Contrarily, the high reduction temperature of the conventional technology will increase the hardness of the powder and decrease the compressibility and sinterability of the powder although it accelerates the reduction reaction.

What is claimed is:

1. A method for fabricating a porous spherical iron-based alloy powder, comprising the steps of:

Step 1: mixing an iron oxide powder and a alloying powder to form a mixed powder, wherein the alloying powder is a metallic element powder which contains at least one element selected from the group consisting of nickel (Ni), molybdenum (Mo), tungsten (W), copper (Cu), and combinations thereof;

Step 2: spray-granulating the mixed powder to form a spherical spray-granulated powder; and Step 3: placing the spherical spray-granulated powder in a reducing environment and heating it to a temperature of lower than 700° C. to obtain a porous spherical iron-based alloy powder having a specific surface area of greater than 0.9 $m^2/g$.

2. The method for fabricating a porous spherical iron-based alloy powder according to claim 1, wherein the iron oxide powder is an iron(III) oxide ($Fe_2O_3$) powder or an iron (II,III) oxide ($Fe_3O_4$) powder.

3. The method for fabricating a porous spherical iron-based alloy powder according to claim 1, wherein the iron oxide powder has an average particle diameter of 0.1 μm-5 μm.

4. A method for fabricating a porous spherical iron-based alloy powder, comprising the steps of:

Step 1: mixing an iron oxide powder and a alloying powder to form a mixed powder, wherein the alloying powder is a metal oxide powder which contains at least one metal oxide selected from the group consisting of nickel oxide (NiO), molybdenum oxide ($MoO_3$), tungsten oxide ($WO_3$), cupric oxide (CuO), cuprous oxide ($Cu_2O$), and combinations thereof;

Step 2: spray-granulating the mixed powder to form a spherical spray-granulated powder; and Step 3: placing the spherical spray-granulated powder in a reducing environment and heating it to a temperature of lower than 700° C. to obtain a porous spherical iron-based alloy powder having a specific surface area of greater than 0.9 $m^2/g$.

5. The method for fabricating a porous spherical iron-based alloy powder according to claim 4, wherein the iron oxide powder is an iron(III) oxide ($Fe_2O_3$) powder or an iron (II,III) oxide ($Fe_3O_4$) powder.

6. The method for fabricating a porous spherical iron-based alloy powder according to claim 4, wherein the iron oxide powder has an average particle diameter of 0.1 μm-5 μm.

* * * * *